United States Patent [19]

Culling

[11] Patent Number: 4,818,483

[45] Date of Patent: Apr. 4, 1989

[54] ALLOY RESISTANT TO SEAWATER AND CORROSIVE PROCESS FLUIDS

[75] Inventor: John H. Culling, St. Louis, Mo.

[73] Assignee: Carondelet Foundry Company, St. Louis, Mo.

[21] Appl. No.: 947,427

[22] Filed: Dec. 29, 1986

[51] Int. Cl.[4] ..... C22C 38/42; C22C 30/02

[52] U.S. Cl. ..... 420/45; 420/46; 420/47; 420/582; 420/584; 420/585; 420/586

[58] Field of Search ..... 420/45, 46, 47, 584, 420/582, 585, 586

[56] References Cited

U.S. PATENT DOCUMENTS 4,400,349 8/1983 Kudo et al. ..... 420/582
4,421,557 12/1983 Rossomme et al. ..... 420/584

FOREIGN PATENT DOCUMENTS 1960025 6/1971 Fed. Rep. of Germany ..... 420/582

*Primary Examiner*—Deborah Yee
*Attorney, Agent, or Firm*—Senniger, Powers, Leavitt and Roedel

[57] ABSTRACT

An air-meltable, workable, castable, weldable, machinable, nonmagnetic alloy resistant to seawater and corrosive process fluids of the type that may be circulated in seawater-cooled heat exchangers. The alloy consists essentially of between about 3% and about 8% by weight manganese, between about 12% and about 28% by weight nickel, between about 17.3% and about 19% by weight chromium, between about 0.68% and about 3.51% by weight copper, between about 0.07% and about 0.25% by weight nitrogen, between about 5.9% and about 8% by weight molybdenum, up to about 0.08% by weight carbon, up to about 1.5% by weight silicon, up to about 0.66% by weight niobium, up to about 1.32% by weight tantalum, up to about 1% by weight vanadium, up to about 1% by weight titanium, up to about 0.6% by weight of a rare earth component selected from the group consisting of cerium, lanthanum, and misch metal, up to about 5% by weight cobalt, and between about 30% and about 56% by weight iron. The titanium equals at least five times any carbon contant in excess of 0.03% by weight. The sum of the cobalt and nickel contents should not be at least about 17% but not exceed about 28% by weight. The sum of the niobium content and one-half the tantalum content should not exceed about 0.66% by weight.

5 Claims, 2 Drawing Sheets

ALLOY RESISTANT TO SEAWATER AND CORROSIVE PROCESS FLUIDS

BACKGROUND OF THE INVENTION

The presence of chlorides or other halides in corrosive media tend to depassivate various alloys, such as stainless steels, that might otherwise resist deterioration in such media quite well. The highly corrosive nature and widespread abundance of seawater and sea air have led to extensive efforts to find materials that are resistant to chlorides.

For maritime application, an alloy has been considered generally satisfactory if it resists corrosion by seawater at ambient temperatures. Recently, however, the extensive use of seawater or brackish water as a cooling medium in heat exchangers has increased, with the result that there is great demand for materials that resist damage by both seawater and the process fluids that are being cooled. In some cases, the process fluid is highly corrosive to many materials, even to some that are able to resist seawater attack. Much progress has been made in developing materials with the required corrosion resistance and other properties. However, such materials have tended to be quite expensive, high in critical or strategic element content, and difficult to prepare and fabricate. Thus, there is great interest in the development of lower cost alloys that are more effective or more efficient than those presently in service in resisting attack by seawater and process fluids.

There is also the desirability in some applications that such alloys be substantially nonmagnetic. One such application is for naval mine-sweepers which must avoid destruction by magnetic mines. Nonmagnetic alloys are also advantageous materials of construction for submarines, since they allow the vessel to elude the magnetic anomaly detector systems that are employed to locate submerged submarines. These systems sense changes in the earth's magnetic field caused by metallic masses as large as steel submarines.

The element titanium and its principal alloys are nonmagnetic, are totally immune to ordinary seawater attack, and have been employed in the hulls of a few submarines and in the heat exchanger tubes of a few seawater-cooled power plants. However, titanium is relatively scarce and expensive, quite difficult to fabricate, and very susceptible to contamination and embrittlement if processed by conventional methods. Hence. Ti weldments tend to crack and leak, and Ti cannot be melted and cast into shapes except under the most rigorous conditions in vacuum or inert gas atmospheres. Also, use of titanium tubing in retrofitting existing heat exchangers may lead to excessive vibration failures unless dampeners are used or support sheets are repositioned.

Thus, there is continued interest in air meltable, castable, weldable, fabricable alloys to resist attack by sea water, and for many applications that remain essentially non-magnetic.

In spite of their excellent overall corrosion resistance, the usual commercial stainless steels are subject to localized corrosion in stagnant seawater. Stagnant conditions arise when the flow rate over the metallic surfaces is less than about 1.2 to 1.6 meters per second (3.9 to 5.2 feet per second), when marine organisms are attached to the surfaces, or where crevices exist. Such conditions are very difficult to avoid completely in actual practice. Thus, although general corrosion of stainless steel components tends to be very low in seawater, very serious damage leading to early failure often occurs because of localized corrosion.

Pitting attack and penetration or perforation of stainless steels tend to take place on broad surfaces with low fluid flow rates, while some form of crevice corrosion takes place where there are imperfect contacts with mud, fouling substances, wood, paint, or other bodies, or even where there are reentrant angles or corners.

A major obstacle to the use of austenitic stainless steels for service in strong chloride environments has been the possibility of chloride stress corrosion cracking. Under conditions of even moderate stress and temperature, type 304 (ordinary 18% Cr 8% Ni) stainless steel will crack at very low chloride levels. Stress corrosion cracking has not really been well understood in the past, but it is now known that improved and highly modified stainless steels of higher molybdenum contents above 3.5% have a degree of resistance to chloride stress corrosion cracking that is more than adequate for most high chloride service.

In my work, I have found very excellent correlation between the critical pitting temperatures and the critical crevice corrosion temperatures of these alloys in seawater, simulated seawater, and similar chloride solutions.

Flue gas scrubbers are now gaining much more attention with the present concern over acid rain and the probable increased use of coal fired power plants as a source of electricity in the place of more nuclear power plants. Scrubbers remove from the flue gas sulfur dioxide ($SO_2$) generated by combustion. The chloride content and pH (hydronium ion activity, or acidity) of the scrubbing liquor, as well as temperatures, affect the pitting and crevice corrosion as well as the stress corrosion cracking of scrubber components. The same alloys that resist these conditions are also quite resistant to $SO_2$, $SO_3$, and the acids formed from these gases.

At the present time there is no generally accepted laboratory test for predicting the corrosion performance of metals in seawater. Despite the lack of adoption to date of a standarized test, there are correlations between such performance and various chloride exposure test. Simple immersion tests at ambient and at elevated temperature, sometimes with plastic spacers, may be used to provide relevant indicative corrosion data.

Table I lists commerical alloys that are employed for service in seawater or brackish water. The last five on the list are ferritic alloys and magnetic. About 1967, improvements in melting and refining methods, along with the previously available vacuum induction and vacuum arc remelt processes, made it possible to produce large heats with very low carbon and nitrogen concentrations. These were vacuum-oxygen decarburization electron beam refining, and argon-oxygen decarburization. The last is now widely employed for the production of ferritic stainless steels in various wrought forms.

These ferritic stainless steels of greater than 24% Cr contents are subject to failure by intergranular attack, sometimes even in plain tap water, and have high brittle transition temperatures unless the total content of carbon plus nitrogen is kept below about 0.0250 to 0.0400%. Small amounts of titanium will stabilize the carbides and nitrides to avoid intergranular attack, but in ferritic stainless steels the presence of such concentrations of Ti also raises the brittle transition temperature above normal ambient earth temperatures. These alloys must be protected on both sides by a blanket of argon or helium gas during welding, and cannot be commercially furnished in cast form. Such severe limitations of the ferritic alloys make the higher-nickel, austenitic alloys more desirable for wrought shapes and mandatory for cast shapes.

TABLE I

| | Ni | Cr | Mo | Cu | Mn | C | N | |
|---|---|---|---|---|---|---|---|---|
| 316L | 10–14 | 16–18 | 2–3 | — | 2 Max | .03 Max | — | |
| 317L | 11–15 | 18–20 | 3–4 | — | 2 Max | .03 Max | — | |
| 317LM | 12–16 | 18–20 | 4–5 | — | 2 Max | .03 Max | — | |
| 904L | 23–28 | 19–23 | 4–5 | 1–2 | 2 Max | .02 Max | — | |
| 254SMO | 18 | 20 | 6.1 | 0.7 | — | .02 Max | 0.2 | |
| NSCD | 16 | 17 | 5.5 | 3 Max | — | .03 Max | — | |
| SANICRO28 | 31 | 27 | 3.5 | 1 | 2 Max | 0.2 Max | — | |
| VEWA963 | 16 | 17 | 6.3 | 1.6 | — | 0.3 Max | 0.15 | |
| IN-862 | 23–25 | 20–22 | 4.5–5.5 | — | 1 Max | 0.7 Max | — | |
| JESSOP JS700 | 24–26 | 19–23 | 4.3–5 | .5 Max | 2 Max | .04 Max | — | Cb8XC to 0.4 Max |
| JESSOP JS777 | 24–26 | 19–23 | 4.3–5 | 1.2–2.5 | 2 Max | .04 Max | — | Cb8XC to 0.4 Max |
| AL6X | 23.5–25.5 | 20–22 | 6–7 | — | 2 Max | .03 Max | — | |
| NITRONIC 50 | 11.5–13.5 | 20.5–23.5 | 1.5–3 | — | 4–6 | .03–.06 | .2–.4 | .1–.3V, .1–.3Cb |
| INCOLOY ALLOY 825 | 38–46 | 19.5–23.5 | 2.5–3.5 | 1.5–3 | 1 Max | .05 Max | — | .2Al, .6–1.2Ti, 22 Min Fe |
| INCONEL ALLOY 625 | 58 Min | 20–23 | 8–10 | — | .5 Max | .10 Max | — | 3.15–4.15Cb + Ta, 5 Max Fe |
| HASTELLOY ALLOY C | Balance | 14.5–16.5 | 15–17 | — | 1 Max | 0.01 Max | — | |
| CARPENTER 20 Cb3 | 32–38 | 19–21 | 2–3 | 3–4 | 2 Max | .07 Max | — | Cb + Ta8XC to 1.00 |
| SUPERFERRIT | 3–3.5 | 27–29 | 1.8–2.5 | — | — | .02 Max | .03 | Max Cb ≧ 12x(C + N) |
| SEA-CURE | 2 | 26 | 3 | — | — | .02 | — | .5Ti |
| AL29-4C | — | 29 | 4 | — | — | .02 | — | .4Ti |
| MONIT | 4 | 25 | 4 | — | — | .025 Max | — | .4Ti |
| FERALLIUM 255 | 5 | 26 | 3 | 2 | — | — | .17 | |

The standard 316L and 317L stainless steel types are not of much value in low velocity or still seawater or where fouling can take place. The nonstandard 317LM has a somewhat higher molybdenum content and is superior to 316L and 317L in such environments. Type 904L contains relatively high proportions of both Mo and Cr, and is generally superior to 317LM.

While Cr and Mo may contribute resistance to chloride corrosion, both are ferritizing elements, so that excessively increasing their contents may render the alloy metallurgically unstable and result in formation of additional phases in the solid alloy such as sigma, eta, martensite and delta ferrite. These additional phases tend to cause immediate vulnerability to chloride failure because of the electrochemical coupling between phases in solution electrolytes. Nickel, manganese, carbon, nitrogen, and to a very slight degree copper, are austenitizers and tend to offset the metallurgical effects of Cr and Mo. Carbon is otherwise detrimental because it tends to form complex chromium carbides and to impoverish the remaining metallic solution in Cr, thus causing failure. Nitrogen forms complex nitrides, but they enhance seawater resistance, if they are present in solid solution. Also, free nitrogen is a gas and must not exceed the solubility of the alloy for total gas content or the metal will develop gas holes and pockets during freezing. Manganese and Cr increase nitrogen solubility.

Among the other commercial alloys of Table I, Nitronic 50, Incoloy Alloy 825, Carpenter 20CB3, Jessop 700 and Jessop 777 have all proven to be susceptible to seawater failure in low velocity, stagnant, crevice or fouling circumstances.

Inconel Alloy 625 and Hastelloy C have good chemical, mechanical and fabricability properties but are nickel-base alloys with 5% or less iron contents.

IN-862 has been offered as a cast equivalent of AL6X, but has about a one percent lower Mo content. H. P. Hack, report DTNSRDC/SME-81/87, December, 1981, by the David W. Taylor Naval Ship Research Center, Bethesda, MD reported on the testing of 45 molybdenum-containing alloys in filtered seawater at the La Que Center for Corrosion Technology, Inc., Wrightsville Beach, N.C. In these U.S. Navy tests 3 panels of each alloy type were polished to 120 grit finish and tested for 30 days in filtered seawater at 30° C. (86° F.). Of the total of 6 sides for each alloy type, 4 of the AL6X were attacked to a maximum depth of 0.62 millimeter (mm) for a 2.5 rating on the David Taylor Naval Ship Research Center ranking system, while the IN-862 was attacked on all 6 sides to a maximum depth of 1.22 mm for 7.3 rating. In these tests only Inconel 625, Hastelloy C and some ferritic alloys in the wrought forms and the same two equivalent alloys in the cast form were completely resistant. My own corrosion tests have been generally consistent with the results reported by Hack on IN-862 and AL6X.

Also, in the tests reported by Hack, the Avesta 254SMO alloy was attacked on 5 of the 6 sides to a maximum depth of 0.51 mm and rated 2.6 by Hack, or about equivalent to AL6X.

The Uddeholm 904L alloy was attacked on 5 sides to a maximum depth of 0.74 mm for a 3.7 rating. The Nitronic 50, Incoloy 825, Carpenter 20Cb3, Jessop 700, Jessop 777, 316, 317L, and 317LM were all attacked on 5 or 6 sides to depths of over 1 mm.

In the Proceedings of the Symposium of the University of Piacenza, Italy, Feb. 28, 1980, titled "Advanced Stainless Steels for Seawater Applications", Bond, et. al., reported the results of a number of advanced stainless steel-type alloys which were exposed for periods up to 272 days in fresh seawater at ambient temperatures at a velocity of two feet per second. The ambient seawater temperature reached a maximum of 25° C. (77° F.). The tests included many of the ferritic alloys plus the AL6X and 254SMO. The AL6X was superficially attacked on two sites of the specimen. The alloy was in a condition that contained a significant amount of a second phase, presumably sigma, and Bond, et. al. said the attack was probably associated with a local inhomogeneity.

In the same Proceedings, Maurer reported on field tests of AL6X in power plant installations dating back to January, 1970. Six tubes failed at United Illuminating Bridgeport Harbor Station after two years of operation with both pitting and crevice corrosion.

While the record for AL6X is good, both this alloy and 904L contain over 50% by weight strategic elements. The latest generation of seawater alloys are 254SMO, NSCD, and VEW A963, all of which contain less than 50% by weight of strategic elements. From Table I, it may be seen that VEW A 963 is a higher-Mo lower-Cu variation of NSCD, and as such, is somewhat more resistant to seawater than the latter. But the most resistant of the three is 254SMO.

SUMMARY OF THE INVENTION

Among the several objects of the present invention, therefore, may be noted the provision of improved alloys resistant to seawater and sea air; the provision of such alloys which are resistant to process streams of corrosive fluids such as may be encountered in heat exchangers cooled by seawater of brackish water; the provision of such alloys which may be economically formulated with relatively low proportions of strategic metals such as nickel, chromium, and molybdenum; the provision of such alloys whose strategic metal content is sufficiently low so that they may be formulated from such relatively low-cost raw materials as scraps, ferro alloys or other commercial melting alloys; the provision of such alloys which can be cast or wrought; the provision of such alloys which have a low hardness and high ductility so that they may be readily rolled, forged, welded and machined; the provision of such alloys which are air-meltable and air-castable; the provision of such alloys which are substantially nonmagnetic, i.e., for military and naval applications such as minesweepers and submarines; the provision of such alloys that do not require heat treatment after welding or hot working to avoid intergranular attack; the provision of such alloys which resist pitting attack, crevice corrosion and stress corrosion cracking failures; and the provision of such alloys which are resistant to localized attack in stagnant seawater.

Briefly, therefore, the present invention is directed to an air-meltable, castable, workable, non-magnetic alloy resistant to corrosion in seawater and sea air. The alloy consists essentially of between about 12% and about 28% by weight nickel, between about 17.3% and 19% by weight chromium, between about 5.9% and about 8% by weight molybdenum, between about 3% and about 8% by weight manganese, between about 0.68% and about 3.51% by weight copper, between about 0.07% and about 0.25% by weight nitrogen, up to about 0.08% by weight carbon, up to about 1.5% by weight silicon, up to about 0.66% by weight niobium, up to about 1.32% tantalum, up to about 1% by weight vanadium, up to about 1% by weight titanium, up to about 0.6% by weight of a rare earth component selected from the group consisting of cerium, lanthanum, and misch metal, up to about 5% by weight cobalt, and between about 30% and about 56% by weight iron. The cobalt may be present as a partial substitute by equal weight for nickel content, and the sum of the nickel and chromium contents should be between about 17% and about 28% by weight. The titanium equals at least five times the carbon content over 0.03% carbon by weight. Thus, titanium may vary between about 0 to about 1% by weight. The sum of the niobium content and one-half the titanium content should not exceed about 0.66% by weight.

In a preferred embodiment of the invention the alloy contains the following components in the indicated ranges of proportions:

| | |
|---|---|
| Nickel | 18–22% |
| Chromium | 17.5–18.5% |
| Molybdenum | 7–8% |
| Copper | 0.7–3.0% |
| Manganese | 3–5% |
| Silicon | 0.20–0.50% |
| Carbon | 0.01–0.03% |
| Nitrogen | 0.15–0.20% |
| Iron | 42–53% |

A particularly advantageous alloy having optimum properties in various services has the following composition:

| | |
|---|---|
| Nickel | 20% |
| Chromium | 18% |
| Molybdenum | 7.3% |
| Copper | 0.8% |
| Manganese | 3.3% |
| Silicon | 0.25% |
| Carbon | 0.02% |
| Nitrogen | 0.20% |
| Iron | Balance (approximately 50%) |

Other objects and features will be in part apparent and in part pointed out hereinafter.

DESCRIPTION OF THE PREFERRED EMBODIMENTS

Figure 1:
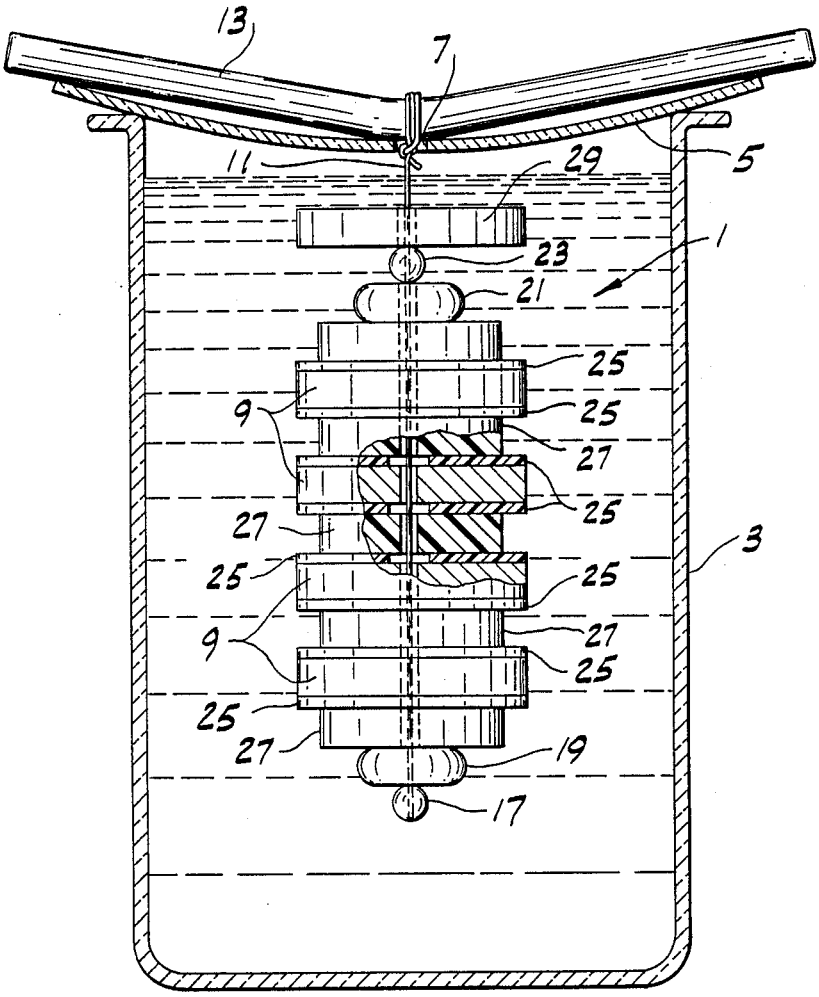
FIG. 1 illustrates the method used to test the alloys of the invention for corrosion in salt water.
Figure 2:
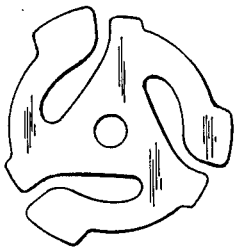
FIG. 2 is a plan view of the phonograph inserts used in the assembly of FIG. 1.

The alloys of the invention include relatively low proportions of strategic metals, yet are virtually immune to seawater in all flow conditions and environments, including contact with other materials such as in fouling or touching other substances, mating metal, wood, plastic, or materials where seepage or seawater penetration may take place. The alloys retain their resistance to pitting crevice corrosion and stress corrosion cracking in chloride solutions whether aerated or stagnant and at all flow velocities. The alloys, because of their resistance to both oxidizing and reducing substances, and to acids and bases, resist the corrosive attack of a wide variety of chemical process fluids such as may be encountered in heat exchangers.

The alloys of the invention are air-meltable and air-castable and possess advantageous mechanical properties which render them suitable as materials of construction for tanks, tubes, pipes, pressure vessels, pumps, agitators, valves, tube sheets and supports for heat exchangers, and cleats, stanchions, pulleys, and deck fittings and tackle for oceangoing ship equipment, as well as hull plates and parts for surface and submarine vessels. The alloys are readily weldable and fabricable. Because they are non-magnetic, the alloys are uniquely suitable for naval applications, particularly in minesweepers and submarines.

Unlike many nickel-base alloys which have previously been available for complete seawater resistance, the alloys of the present invention can be formulated from ferro-alloys, scraps and commercial melting alloys, even those which may contain impurities or contaminants that are detrimental to the seawater resistance or other properties of prior alloys. Contaminants or impurities such as carbon, silicon, columbium (niobium) or high copper content, that have been considered detrimental in prior alloys are either compatible with my alloys or may be neutralized by small amounts of titanium or misch metal.

The alloys of the present invention may contain as little as 30% by weight of iron, if extremely corrosive substances in addition to the sea water are to be encountered, but they may contain as much as about 56% by weight of iron if only seawater, other chlorides or halide ions, and less corrosive process fluids are to be encountered. For most ocean going vessels and seawater applications, they ordinarily contain between about 49 and about 56% by weight of iron. The alloys can easily be made with less than 50% total strategic metal content, while remaining resistant to attack by seawater at all ambient temperatures and conditions.

The outstanding corrosion resistance of the alloys of this invention is attributable in part to the fact that they are single-phase solid solutions having an austenitic (face-centered cubic) structure. Other prior art alloys in some states of heat treatment contain additional deleterious phases such as sigma, eta or delta ferrite. Attainment of single phase structure does not require heat treatment but is realized in the as-cast condition of the alloy, and yet structural welding or fabrication heating does not adversely affect their resistance to seawater.

While additions of 15 to about 32% by weight of molybdenum to nickel-base alloys have been found to resist corrosion by hydrochloric acid and certain other chloride solutions under special conditions, such alloys fail by general attack in seawater if chromium is not also present.

Combinations of Cr and Mo within the range of proportions of the invention contribute significantly to the resistance of those alloys against attack by seawater. Moreover, where the combination of Cr and Mo satisfies the preferred relationship $$[Mo] \geqq \frac{31}{[Cr] - 12} + 2$$

where

[Mo]=weight % molybdenum and

Figure 3:
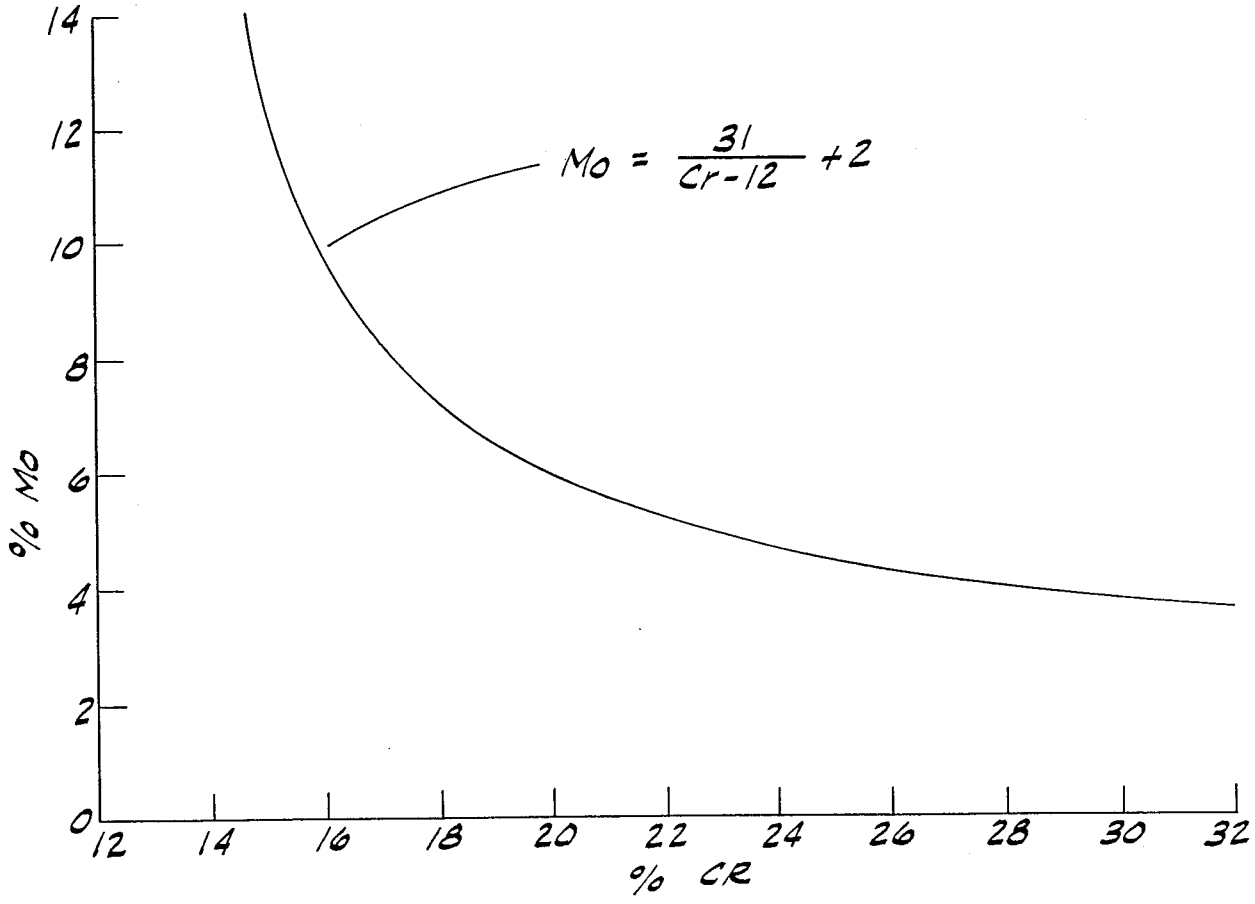
FIG. 3 is a plot of an algorithm useful in formulating alloys resistant to chloride stress corrosion cracking.

[Cr]=weight % chromium.

it has been found that the alloys of the invention are especially resistant to $Cl^-$ stress corrosion cracking, as well as $Cl^-$ pitting. A plot of this algorithm is set forth in FIG. 3. Alloys having a combination of Cr and Mo falling above and/or to the right of the curve have been found to exhibit effective resistance to stress corrosion cracking.

Hastelloy Alloy C and its variants contain about 15 to 16% chromium with about 15 to 17% molybdenum but can only tolerate about 5% iron in their nickel-base formulations. When alloys of substantially reduced nickel and substantially increased iron contents are formulated, somewhat higher chromium contents have been found to be required for excellent seawater resistance. The 17% by weight chromium found in alloys such as NSCD and VEWA963 is not quite high enough to maintain passivity when seawater temperatures are considerably elevated in some heat exchangers, in the presence of many process fluids or under certain conditions of stagnation or contact with ordinary seawater when flow velocities are low enough. The slightly higher chromium levels of the alloys of this invention were found to substantially overcome such problems.

On the other hand, the alloys of this invention still possess lower maximum chromium contents than 254SMO, AL6X, 904L, IN-862, and many other similar families of alloys. The maximum chromium level in alloys of this invention has been limited to only the amount required to maintain passivity in order to maintain metallurgical stability of the single-phase solid solubility in the presence of the other alloy components of the invention.

It should be remembered that the formulations for virtually all the most effective prior art alloys for seawater service require that the carbon content be less than 0.03% or even less than 0.02% C. These low limits are difficult to obtain and maintain by ordinary melting and processing methods, particularly in the production of casting by the usual methods. The alloys of the present invention may tolerate somewhat higher carbon contents, allowing for titanium additions of at least 5 times the carbon content over 0.03%. The titanium content may be somewhat higher than such values without detriment to seawater resistance, for while Cb (Nb) as a carbide stabilizer is generally detrimental to seawater resistance, Ti actually enhances it. On the other hand the Ti may be eliminated in the event that the melting stock might sometimes be of sufficiently low carbon content so as not to require any stabilization. Titanium may also obviously be eliminated in the event sufficiently large melts are made up to prepare ingots to produce the various wrought forms such that decarburization practices may be warranted. It should be specifically noted that the alloys of this invention are not nearly as sensitive to damaging of seawater resistance by the presence of Cb (Nb) as are most prior art alloys such as disclosed in the U.S. Navy tests of Hack and others. Indeed 0.66% Cb is present as a deliberate addition to one of the test melts of alloys of this invention to demonstrate this fact.

Nitrogen is a necessary addition to alloys of this invention, but must not exceed the gas solubility limit if sound castings and ingots are to be obtained. The 0.25% maximum is easily within such limits in my alloys because Cr, Mn, and Mo all increase the solubility of nitrogen gas in molten or freezing steels and alloys.

Copper is felt by most workers in this field to be somewhat undesirable for seawater resistance. In most prior art alloys, Cu above about 0.8% is felt to be undesirable. Indeed Hack and others have reported that higher Cu contents increase both initiation and growth of crevice corrosion and pitting. However, Cu is a desirable element in alloys of the present invention, not only for its concentration to seawater resistance but also because it enhances resistance to many other process fluids, notably most concentrations of sulfuric and sulfurous acids.

Silicon is held to a maximum of about 1.5% in alloys of this invention so as not to damage their fabricability or weldability. Higher Si values do not harm or reduce seawater resistance but are undesirable for the above mentioned reason.

Manganese is a well-known steel deoxidizer and is present in relatively large amounts in alloys of this invention. Since most steels commercially produced use some combination of Mn and Si for deoxidation purposes, Si is often added to help insure clean, sound ingots and casting. But with the high Mn contents of alloys of this invention, Si is not intentionally added and may often reach only about 0.25% by weight or less without detriment. Therefore, the only practical lower limit to Si content in alloys of this invention results from the tiny amounts absorbed from furnace linings or molds or from its presence in certain raw material.

The manganese content in alloys of this invention serves many functions aside from thorough deoxidation. Mn also enhances seawater resistance in the presence of Mo, which is also present in relatively large amounts in the alloys of this invention. The Mn also increases nitrogen solubility, as noted above, and therefore helps stabilize the desirable austenitic, or face-centered, cubic structure of the matrix. As noted by Bond and others, inhomogeneity of structure, as sometime found in certain conditions of AL6X and other alloys, is largely avoided in alloys of this invention despite their relatively low Ni and high Mo contents.

Nickel is present in alloys of this invention in relatively low amounts for such high Mo contents. Generally, it is present in a proportion of at least about 17% by weight and may reach 28% without detriment to seawater resistance, but is normally held to the low side of the range for usual sea service or when especially corrosive process fluids are not also to be encountered. About 18% to about 22% by weight nickel is normally and preferably present. As indicated below, Co may be substituted in part for Ni, so that the Ni content as such may be as low as 12%, provided that the sum of the Ni and Co content is at least about 17% by weight.

Cerium, lanthanum, misch metal, or some combination of rare earth elements may arbitrarily be added in small amounts to a total weight percent content of up to about 0.6% for the purpose of improving hot workability of ingots of alloys of this invention, according to the principles set forth by Post et al., U.S. Pat. No. 2,553,330.

There are corrosion resistant alloys based upon titanium, zinc, aluminum, zirconium, copper, lead, or even chromium, but corrosion resistant alloys based upon iron and nickel generally employ the elements discussed above in varying proportions, according to the purposes intended. Sometimes some of these elements are reduced to the vanishing point, but Fe/Cr alloys typically involve these same elements. There have been attempts to employ tungsten, sometimes as a substitute for molybdenum, and sometimes tungsten is present up to one to four weight percent as an incidental element introduced in the manufacturing logistics. But tungsten is never as effective as and seldom equivalent to molybdenum in management of corrosion except in those alloys intended to be employed near or above about 1000° F., in which instances a compromise substitution of tungsten is typically made for the sake of hot strength or hot hardness, not corrosion resistance.

Sometimes tantalum is also present in these corrosion resistant alloys, but that is because tantalum occurs in natural ores along with columbium in most deposits, and it is easier to alloy its inclusion than to require its exclusion. However, tantalum functions in the same manner chemically as columbium in these alloys, but is twice as scarce and about twice as dense and hence only about one-fourth as cost effective as columbium. Tantalum can be present in a proportion of up to about 1.32% by weight, but the sum of columbium (niobium) and one-half the tantalum should not exceed about 0.66% by weight.

Attempts have also been made in include antimony, bismuth, and even lead in iron-and nickel-base corrosion resistant alloys, but these elements are not compatible metallurgically with the transition elements, iron and nickel. The metallurgical and fabricability problems imposed by the presence of Sb, Bi and Pb have, over the tests of time and trial, led to the ultimate exclusion of functional proportions of such elements from this system of alloys.

Alloys of this invention may actually contain vanadium up to approximately 1% by weight without detriment. The vanadium in solid solution somewhat enhances resistance to seawater, and indeed in my research tests has been explored in proportions well above 1%. It is, however, a very powerful ferritizer and is limited in this invention to avoid the necessity of increasing nickel content any further.

In my work, I have learned that V up to about 12% or less can be partially substituted for Mo, but cannot entirely displace it. Therefore, large amounts of V have not proven desirable in these seawater resistant alloys. In amounts below about 1% vanadium, this element may be arbitrarily added for purposes of increasing strength, hardness, or resistance to galling and wear.

Even platinum, iridium, gold and silver have been added to iron-and nickel-base corrosion resistant alloys, often with dramatic effect, but such elements are of such rarity and scarcity of abundance in the earth's crust, that their use has never achieved commercial status.

Cobalt, as a sister element to Ni in chemical properties and in the periodic table, is often found to coexist in ore bodies with Ni at a ratio of about one to fifty. As such, it is difficult and costly to completely eliminate from Ni derived from these ores. Metallurgically Co tends to form the hexagonal crystal lattice rather than the cubic latice favored by Ni, Fe, and Cr. In the field of corrosion Co is to Ni about what Ta is to Cb and W is to Mo; the first of each pair is generally neither desirable nor undesirable in amounts most likely to be considered. In the loweer ranges each is acceptable as a more costly partial substitute for the latter but not acceptable or desirable as a total substitute for the latter.

In alloys of this invention Co has been found to be acceptable as a partial substitute for Ni in quantities up to about 5% Co on an equal weight basis, except in the field of atomic energy, in which case intense radiation may result in the formation of the radioactive isotope Co 60, an undesirable situation. The presence of Co is otherwise neither especially desirable nor objectionable in amounts to about 5% by weight as a partial substitute for Ni. In my tests, I have substituted cobalt for nickel in corrosion resistant alloys up to about 5% without apparent advantages or disadvantages. The sum of Co and Ni contents should be at least about 17% by weight, but not greater than about 28% by weight.

EXAMPLE 1

Alloy samples for testing were prepared in a 100-pound high frequency induction furnace. Well-risered standard physical test blocks and heavily-tapered and well-risered cylinders were cast to secure clean, sound, porous-free samples. In some instances only as-cast materials were tested, but in the case of others, including representative alloys of this invention, additional samples were annealed at 1550° F. for five hours, or annealed at 1925° F. for 1½ hours and then water quenched to room temperature. Thus, alloys of this invention were available in the as cast condition and the solution annealed condition. The purpose of providing alloys in both of the latter two conditions was to evaluate the possible effects of heat treatments upon seawater resistance.

The corrosion test samples were machined from the cylindrical test bars into discs 1½" in diameter by ¼" thick with ⅛" diameter hole drilled in the center of each. These machined samples were machine ground, then polished through 600 grit metallographic paper to the final dimensions listed above.

The most often employed corrosion testing solution was prepared by dissolving 4 ounces of ordinary retail, uniodized, granulated table salt per gallon of St. Louis, Mo. tap water. Distilled water was not used, because it was felt that seawater contains many impurities and components. Also, the St. Louis water precipitates moderate amounts of calcium carbonate and other substances as a cloud of particles which settle on samples in quiet solution immersion tests. The settling of these particles on horizontal test surfaces tends to promote localized corrosion. This concentration of salt is about average for most of the ocean water of the world.

Some of the test samples were simply placed in shallow plastic containers in the salt solution at ambient temperature, which varied between 68° F. and 82° F. Other samples were placed between plastic spacers and suspended by platinum wire in the salt solution of 4 oz. salt per gallon of tap water, thermostatically maintained at 50° C. (122° C.), as shown in FIG. 1.

In the system illustrated in FIG. 1, the corrosive solution 1 is contained within a glass beaker 3 that is covered with a watch glass 5 having a central hole 7 therein. Specimens 9 for testing are suspended on a platinum wire 11 attached at is upper end to a bent glass tube 13. An assembly 15 of specimens, each 1.5" dia×⅛" thick with a ⅛" hole in the center (machined; grind finish, 600 grit metallographic paper final finish), is supported on a plastic bead 17 attached to the bottom of wire 11 and a plastic spacer 19 (about 0.7" dia.) centered on the wire just above the bead. Another spacer 21 and bead 23 are centered above the assembly of specimens. Each specimen 9 is separated from the next adjacent specimen by a plastic 45/33 phonographic disc adapter insert 25 (about 1½" max. dia.×1/16" thick), a plastic checker 27 (1.2" max. dia.×about ¼" max. thickness, with ⅛" hole drilled in center), and another disc adapter. A weight 29 centered on the wire above bead 23 compresses the various components of the assembly together.

Typical alloys of this invention are listed in Table II by weight percentages:

TABLE II

| ALLOY NUMBER | Ni | Cr | Mo | Cu | Mn | N | Cb | C | Ti | Si |
|---|---|---|---|---|---|---|---|---|---|---|
| 1256 | 18.80 | 17.56 | 5.98 | 3.36 | 4.07 | .12 | .66 | .08 | — | .27 |
| 1337 | 212.5 | 18.55 | 6.26 | 3.51 | 7.72 | .09 | — | .034 | — | .88 |
| 2337 | 20.20 | 17.32 | 5.90 | 3.19 | 7.98 | .24 | — | .08 | .45 | .28 |
| 1399 | 19.02 | 17.69 | 7.86 | .68 | 3.84 | .11 | — | .01 | — | .31 |
| 1398 | 19.75 | 17.93 | 7.49 | .87 | 3.36 | .18 | — | .01 | — | .26 |
| 2398 | 20.60 | 17.80 | 6.79 | .97 | 3.37 | .18 | — | .03 | — | .24 |
| 1408 | 17.68 | 17.95 | 6.90 | 1.37 | 3.35 | .21 | — | .02 | — | .11 |
| 1396 | 19.73 | 18.04 | 6.78 | 1.10 | 3.88 | .15 | — | .01 | — | .25 |
| 2396 | 18.73 | 18.30 | 6.39 | 1.16 | 3.78 | .15 | — | .03 | — | .32 |
| 1405 | 19.41 | 18.67 | 6.80 | 1.40 | 3.62 | .11 | — | .01 | — | .14 |
| 2405 | 19.00 | 18.99 | 6.99 | 1.43 | 3.35 | .07 | — | .02 | — | .26 |

The mechanical properties of these alloys were measured and the results set forth in Tables III, IV, and V.

TABLE III

PHYSICAL PROPERTIES OF ALLOYS AS CAST

| ALLOY NUMBER | TENSILE STRENGTH P.S.I | YIELD STRENGTH P.S.I. | TENSILE ELONGATION % | BRINELL HARDNESS NUMBER |
|---|---|---|---|---|
| 1256AC | 66,240 | 31,080 | 18.5 | |
| 1337AC | 96,670 | 52,130 | 50.0 | 187 |
| 2337AC | 94,300 | 51,100 | 48.0 | 188 |
| 1399AC | 72,970 | 33,560 | 21.0 | 170 |
| 1398AC | 83,700 | 40,380 | 37.5 | 179 |
| 2398AC | 82,750 | 40,100 | 36.5 | 181 |
| 1408AC | 80,200 | 45,840 | 20.0 | 172 |
| 1396AC | 73,910 | 43,170 | 19.0 | 187 |
| 2396AC | 72,200 | 42,230 | 20.0 | 190 |
| 1405AC | 68,400 | 37,740 | 12.5 | 181 |
| 2405AC | 67,300 | 36,800 | 13.0 | 179 |

TABLE IV

PHYSICAL PROPERTIES ANNEALED 5 HOURS AT 1550° F.

| ALLOY NUMBER | TENSILE STRENGTH P.S.I. | YIELD STRENGTH P.S.I. | TENSILE ELONGATION % | BRINELL HARDNESS NUMBER |
|---|---|---|---|---|
| 1399AN | 74,200 | 37,290 | 18.5 | 156 |
| 1398AN | 83,870 | 41,930 | 28.0 | 156 |
| 2398AN | 83,550 | 40,880 | 29.0 | 165 |
| 1408AN | 77,200 | 46,100 | 17.5 | 175 |
| 1396AN | 72,900 | 46,440 | 9.0 | 156 |
| 2396AN | 73,300 | 46,550 | 10.0 | 165 |
| 1405AN | 67,200 | 37,500 | 10.1 | 180 |
| 2405AN | 66,500 | 37,200 | 10.1 | 179 |

TABLE V

PHYSICAL PROPERTIES ANNEALED 5 HOURS AT 1550° F.

| ALLOY NUMBER | TENSILE STRENGTH P.S.I. | YIELD STRENGTH P.S.I. | TENSILE ELONGATION % | BRINELL HARDNESS NUMBER |
|---|---|---|---|---|
| 1399WQ | 78,000 | 40,140 | 19.0 | 187 |
| 1398WQ | 87,990 | 43,780 | 21.5 | 187 |
| 2398WQ | 86,650 | 43,680 | 25.5 | 188 |
| 1408WQ | 77,900 | 43,350 | 13.5 | 193 |
| 1396WQ | 81,200 | 45,400 | 9.0 | 192 |
| 2396WQ | 82,400 | 46,300 | 11.0 | 193 |
| 1405WQ | 71,600 | 44,000 | 10.0 | 185 |
| 2405WQ | 70,200 | 42,100 | 9.9 | 185 |

Additional test samples of other alloys not of this invention were prepared in the same way and set forth in Table V.

EXAMPLE 2

Test discs from all alloys of this invention in the as-cast condition, and all except those of 1256 and 1337 in the 1925° F. quenched condition and in the 1550° F. annealed condition, were placed in about 1½" depth of the salt solution in plastic containers fitted with virtually air tight lids. Test discs of representative examples of other alloys not of this invention in the as-cast condition were also placed in such containers. Twenty-five samples were in each container. They were not touching each other or any other metal—only the bottom of the container. Compositions of the various alloys tested in accordance with this example are set forth in Table VI. In each case, the balance of the composition was essentially Fe.

TABLE VI

| NAME OR NUMBER | COMPOSITIONS OF ALLOYS - % BY WEIGHT ALLOYING ELEMENTS | | | | | | | | |
|---|---|---|---|---|---|---|---|---|---|
| | Ni | Cr | Mo | Cu | Mn | C | Si | N | Cb |
| 992 | 25.14 | 16.82 | 6.34 | 4.53 | 7.67 | .06 | .28 | — | — |
| 1226 | 28.59 | 21.02 | 4.73 | 3.50 | 3.83 | .03 | .66 | — | 1.58 |
| 1344 | 20.42 | 19.30 | 4.61 | 3.57 | 3.89 | .42 | 1.28 | — | 3.50 |
| 1225 | 31.19 | 26.33 | 3.02 | 3.55 | 3.30 | .06 | .63 | — | 2.38 |
| 1302 | 23.69 | 20.30 | 2.10 | 3.09 | 3.47 | .02 | .34 | — | .62 |
| 1295 | 34.89 | 30.21 | 1.99 | 3.00 | 4.44 | .03 | .28 | — | .79 |
| 1401 | 21.71 | 18.48 | 1.98 | 2.35 | 3.30 | .01 | .11 | — | .31 |
| 1404 | 24.88 | 20.16 | 1.95 | 2.54 | 3.98 | .01 | .23 | — | .76 |
| 1365 | 10.20 | 17.23 | 1.48 | — | 9.40 | .01 | .34 | .24 | — |
| 1349 | 23.20 | 22.15 | .29 | 3.34 | 3.90 | .021 | .44 | — | .10 |
| 1379 | 21.50 | 18.95 | .90 | 3.59 | 4.33 | .03 | .29 | — | .61 |
| 1329 | 27.66 | 29.34 | 2.01 | 3.15 | 3.61 | .08 | .31 | .15 | .76 |
| 1372 | 18.91 | 17.66 | 1.10 | 3.51 | 3.91 | .03 | 2.60 | — | .57 |
| 1358 | 24.29 | 20.50 | — | 3.30 | 4.10 | .02 | .21 | — | .15 |
| 1366 | 10.33 | 18.08 | 1.55 | — | 6.01 | .01 | .56 | .19 | .18 |
| 1371 | 18.38 | 18.15 | — | — | .86 | .03 | 1.91 | — | — |
| 1381 | 22.09 | 19.05 | .93 | 3.58 | 4.29 | .03 | .24 | — | .58 |
| 1315 | 28.21 | 27.16 | 2.17 | 3.17 | 4.03 | .02 | .20 | .16 | .35 |
| 1299 | 24.95 | 20.51 | 1.09 | 3.08 | 3.66 | .03 | .17 | — | 1.36 |
| 20Cb3 | 32.14 | 20.68 | 2.08 | 3.12 | 1.05 | .03 | .28 | — | .62 |
| IN862 | 24.81 | 21.20 | 4.75 | — | .46 | .03 | .77 | — | — |
| 254SMO | 18.86 | 20.86 | 6.15 | .81 | .51 | .01 | .24 | .20 | — |
| 1406 | 15.07 | 14.64 | 8.34 | 1.41 | 3.19 | .02 | .26 | .14 | — |
| 1407 | 15.27 | 17.24 | 6.90 | 1.70 | 3.35 | .01 | .25 | .19 | — |
| 1409 | 16.00 | 19.96 | 5.59 | .81 | 3.12 | .02 | .17 | .24 | — |
| 2408 | 16.06 | 18.14 | 6.90 | 1.40 | 2.98 | .04 | .36 | .21 | — |

The liquid from each container was siphoned off once every seven days and replaced by freshly prepared salt solution. The top surfaces of all discs were examined for the appearance of pits or rust spots, which first appeared as reddish colored spots.

After 160 days of exposure at ambient temperatures, none of the discs of the alloys of this invention in any of the three conditions of heat treatment had formed any rust spots. The numbers of days for each alloy not of this invention required for the first rust spot to appear is given in Table VII.

TABLE VII

| Alloy | Days* | Alloy | Days* | Alloy | Days* |
|---|---|---|---|---|---|
| 992 | 20 | 1358 | 18 | 1409WQ | 55 |
| 1226 | 48 | 1366 | 1 | 1409AN | 41 |
| 1344 | 26 | 1371 | | 2408AC | 35 |
| 1225 | 35 | 1381 | 1 | 2408WQ | 55 |
| 1302 | 35 | 1315 | 1 | 2408AN | 31 |
| 1295 | 25 | 1299 | 7 | 20Cb3 | 23 |
| 1401 | 21 | 1406AC | 84 | IN862 | 46 |
| 1404 | 23 | 1406WQ | 55 | 254SMOAC | 79 |
| 1365 | 40 | 1406AN | 48 | 254SMOWQ | 41 |
| 1349 | 22 | 1407AC | 55 | 254SMOAN | 34 |
| 1379 | 2 | 1407WQ | 65 | | |
| 1329 | 10 | 1407AN | 36 | | |
| 1372 | 10 | 1409AC | 88 | | |

*Period of Exposure Before First Appearance of Rust Spots (days)

The following alloys showed no rust spots after 160 days exposure.

| | | | |
|---|---|---|---|
| 1256 | 1337 | 2337 | 1399AC |
| 1399WQ | 1399AN | 1398AC | 1398WQ |
| 1398AN | 2398AC | 2398WQ | 2398AN |
| 1408AC | 1408WQ | 1408AN | 1396AC |
| 1396WQ | 1396AN | 2396AC | 2396WQ |
| 2396AN | 1405AC | 1405WQ | 1405AN |
| 2405AC | 2405WQ | 2405AN | |

EXAMPLE 3

Test discs of a number of alloys of this invention plus a number of the relatively resistant alloys not of this invention, all in the as cast condition, were weighed and suspended in sodium chloride solution at 50° C. (122° F.) in the manner shown in FIG. 1 for 160 days, with the test solution being replaced with fresh solution every month. These discs were then removed, washed, reweighed and examined for appearance. The results are set forth in Table VIII and Table IX.

TABLE VIII

AS CAST SAMPLE FROM 50° C., 160 DAYS ALLOYS OF THIS INVENTION

| | |
|---|---|
| 1398AC: | 0.0000 grams weight loss. Both faces had very, very faint shadowy color stains of rainbow hues. |
| 1399AC: | 0.0000 grams weight loss. Both faces similar to 1398AC. |
| 1396AC: | 0.0000 grams weight loss. Both faces had very slightly deepening of color stains compared to 1398AC and 1399AC. |
| 1405AC: | 0.0012 grams weight loss. Both faces about like 1396AC except two featheredge darker streaks on one face following trace of phono disc adapter. |
| 1408AC: | 0.0014 grams weight loss. Appearance almost exactly like 1405AC. |

TABLE IX

AS CAST SAMPLES FROM 50° C., 160 DAYS ALLOYS NOT OF THIS INVENTION

| | |
|---|---|
| 1371AC: | 0.2691 grams weight loss. Coarse rusting over much of the area of both faces with deep etching following lines of phono disc adapter outline. |
| 1381AC: | 0.1764 grams weight loss. Much less area of rust and etching than 1371AC. |
| 1397AC: | 0.0186 grams weight loss. Brown stains under phono insert shape, partially on one face and extensively on the other, with outlines of rust and pitting on both faces. |
| 2545MOAC: | 0.0088 grams weight loss. Streaks of faint rust outline much of phono disc insert shape on both faces. |
| 1406AC: | 0.0048 grams weight loss. Fairly faint stains on one face. On the opposite face stronger stains with fringes of faint rust around phono insert shape and one streak of heavy rust. |
| 1407AC: | 0.0037 grams weight loss. Streaks of faint rust outline much of the phono disc adapter shape on both faces. |
| 1409AC: | 0.0031 grams weight loss. Both faces faintly rusted with areas of etching top and bottom. |
| 2408AC: | 0.0056 grams weight loss. Yellow to brown stains on both faces with outlines of rust around phono disc inserts. |

EXAMPLE 4

Test discs of the same alloys used in Example 3 but in the water quenched and in the annealed condition were also suspended in the salt solution for 65 days at 50° C. (122° F.) but otherwise handled as in Example 2 above. Results of these tests are shown in Table X. Appearances of the as cast samples approximately matched those of the samples subjected to the 160 day test, but weight losses were less, perhaps as a result of the shorter exposure time.

TABLE X

50° C., 65 DAYS EXPOSURE

| WATER QUENCHED | | ANNEALED | |
|---|---|---|---|
| SAMPLE | GRAMS WEIGHT LOSS | SAMPLE | GRAMS WEIGHT LOSS |
| 1398WQ | NIL | 1398AN | NIL |

TABLE X-continued

| 50° C., 65 DAYS EXPOSURE | | | |
|---|---|---|---|
| WATER QUENCHED | | ANNEALED | |
| SAMPLE | GRAMS WEIGHT LOSS | SAMPLE | GRAMS WEIGHT LOSS |
| 1399WQ | NIL | 1399AN | NIL |
| 1396WQ | NIL | 1396AN | NIL |
| 1405WQ | 0.0006 | 1405AN | 0.0005 |
| 1408WQ | 0.0004 | 1408AN | 0.0005 |
| 1371WQ | 0.1088 | 1371AN | 0.1131 |
| 1381WQ | 0.0762 | 1381AN | 0.0579 |
| 1397WQ | 0.0076 | 1397AN | 0.0084 |
| 254SMOWQ | 0.0047 | 254SMOAN | 0.0053 |
| 1406WQ | 0.0035 | 1406AN | 0.0041 |
| 1407WQ | 0.0027 | 1407AN | 0.0029 |
| 1409WQ | 0.0025 | 1409AN | 0.0031 |
| 2408WQ | 0.0033 | 1408AN | 0.0038 |

EXAMPLE 5

In my work with stainless steels and highly modified stainless steels I have observed that mixtures of about 10% or more concentration of sulfuric acid with about 5% or more concentration of nitric acid form very aggressive corrosive solutions, particularly when hot. Therefore, for this example, I suspended test discs of alloys of this invention plus several others for comparison in a solution of 15% sulfuric acid, 15% nitric acid, balance water, for exactly six hours at 50° C. (122° F.) after carefully cleaning the polished discs with alcohol solution. The results of these tests are presented in Table XI. It is recognized that in some instances a deterioration rate of about 0.020 inches per year (I.P.Y.) may be tolerated. However, about 0.010 I.P.Y. is more usually considered about maximum for good performance, while about 0.005 I.P.Y. or less is generally quite excellent. The alloys of this invention are seen to resist the attack of this very aggressive corrodant quite remarkably, a fact which indicates their suitability for handling corrosive process streams in fresh water or seawater-cooled heat exchangers.

TABLE XI

| I.P.Y. CORROSION ATTACK IN 15% $H_2SO_4$ + 15% $HNO_3$ at 50° C. (122° F.) SAMPLE CONDITION | | | | | |
|---|---|---|---|---|---|
| AS CAST | | WATER QUENCHED | | ANNEALED | |
| 1396AC | 0.0046 | 1396WQ | 0.0036 | 1396AN | 0.0039 |
| 1398AC | 0.0070 | 1398WQ | 0.0059 | 1398AN | 0.0061 |
| 1399AC | 0.0000 | 1399WQ | 0.0000 | 1399AN | 0.0000 |
| 1405AC | 0.0000 | 1405WQ | 0.0000 | 1405AN | 0.0000 |
| 1408AC | 0.0014 | 1408WQ | 0.0011 | 1408AN | 0.0012 |
| 1256AC | 0.0035 | | (As-cast discs only available) | | |
| 2396AC | 0.0037 | 2396WQ | 0.0042 | 2396AN | 0.0036 |
| 2405AC | 0.0000 | 2405WQ | 0.0000 | 2405AN | 0.0000 |
| 254SMOAC | 0.0113 | 254SMOWQ | 0.0112 | 254SMOAN | 0.0122 |
| VEWA963AC | 0.0127 | VEWA963WQ | 0.0115 | VEWA963AN | 0.0125 |
| 1406AC | 0.0016 | 1406WQ | 0.0015 | 1406AN | 0.0018 |
| 1407AC | 0.0019 | 1407WQ | 0.0017 | 1407AN | 0.0021 |
| 1409AC | 0.0011 | 1409WQ | 0.0012 | 1409AN | 0.0020 |

EXAMPLE 6

Test discs ($1\frac{1}{2}''$ diameter by $\frac{1}{4}''$ thick) of a number of alloys of this invention were suspended in 35% nitric acid solution at 80° C. for six days. These discs were carefully weighed to the nearest 10,000th of a gram before and after exposure and the weight loss calculated in inches per year, by the following formula:

$$R_{ipy} = 0.3937 \frac{W_o - W_f}{ATD}$$

where $R_{ipy}$=corrosion rate in inches per year
$W_o$=original weight of sample
$W_f$=final weight of sample
A=area of sample in square centimeters
T=duration of the test in years
D=density of alloy in b/cc Results of this test are set forth in Table XII.

TABLE XII

| CORROSION RATES IN 35% $HNO_3$-WATER SOLUTION AT 80° C. (176° F.) | |
|---|---|
| ALLOY NUMBER | LOSSES IN INCHES OF PENETRATION PER YEAR (I.P.Y.) |
| 1256 | 0.0038 |
| 1336 | 0.0008 |
| 2337 | 0.0009 |
| 1399 | 0.0036 |
| 1398 | 0.0011 |
| 2398 | 0.0013 |
| 1408 | 0.0024 |
| 1396 | 0.0000 |
| 2396 | 0.0000 |
| 1405 | 0.0014 |
| 2405 | 0.0003 |

EXAMPLE 6

Test discs of a number of alloys of this invention were suspended in 25% sulfuric acid-water solution at 80° C. for six days in the manner described in Example 5. The results of these test are set forth in Table XIII.

| CORROSION RATES IN 25% $H_2SO_4$-WATER SOLUTION AT 80° C. (176° F.) | |
|---|---|
| ALLOY NUMBER | LOSSES IN INCHES OF PENETRATION PER YEAR (I.P.Y.) |
| 1256 | 0.0035 |
| 1377 | 0.0028 |
| 2337 | 0.0025 |
| 1399 | 0.0053 |
| 1398 | 0.0031 |
| 2398 | 0.0033 |
| 1408 | 0.0051 |
| 1396 | 0.0029 |
| 2396 | 0.0031 |
| 1405 | 0.0035 |
| 2405 | 0.0037 |

EXAMPLE 7

Test discs of a number of alloys of this invention were suspended in a water solution containing 25% sulfuric acid, 10% nitric acid and 4 ounces per gallon of sodium chloride, in the manner described in Examples 5 and 6. The results of these tests are set forth in Table XIV.

| CORROSION RATES IN 25% $H_2SO_4$-10% $HNO_3$-WATER SOLUTION PLUS 4 OUNCES/GALLON NACl AT 80° C. | |
|---|---|
| ALLOY NUMBER | LOSSES IN INCHES OF PENETRATION PER YEAR (I.P.Y.) |
| 1256 | 0.0078 |
| 1337 | 0.0028 |
| 2337 | 0.0037 |
| 1399 | 0.0052 |
| 1398 | 0.0024 |
| 2398 | 0.0019 |
| 1408 | 0.0042 |
| 1396 | 0.0024 |
| 2396 | 0.0021 |
| 1405 | 0.0105 |
| 2405 | 0.0038 |

In view of the above, it will be seen that the several obejcts of the invention are achieved and other advantageous results attained.

As various changes could be made in the above products without departing from the scope of the invention, it is intended that all matter contained in the above description shall be interpreted as illustrative and not in a limiting sense.

What is claimed is:

1. An air meltable, workable, castable, weldable, machinable, nonmagnetic alloy having a single phase austenitic structure and being resistant to seawater and corrosive process fluids, the alloy consisting essentially of between about 3% and 8% by weight manganese, between about 12% and 28% by weight nickel, between about 17.3% and about 19% by weight chromium, between about 0.68% and about 3.51% by weight copper, between about 0.07% and about 0.25% by weight nitrogen, between about 5.9% and about 8% by weight molybdenum, up to about 0.08% by eight carbon, up to about 1.5% by weight silicon, up to about 0.66% by weight niobium, up to about 1.32% by weight tantalum, up to about 1% by weight vanadium, up to about 1% by weight titanium, up to about 0.6% by weight of a rare earth component selected from the group consisting of cerium, lanthanum, and misch metal, up to about 5% by weight cobalt, and between about 30% and about 56% by weight iron, the titanium content being at least about five times any excess of carbon content above 0.03% by weight, the sum of the cobalt content and the nickel content being between about 17% and about 28% by weight, and the sum of the niobium content and one-half the tantalum content not exceeding about 0.66% by eight.

2. An alloy is set forth in claim 1 containing between about 18% and about 22% by weight nickel, between about 17.5% and about 18.5% by weight chromium, between about 7% and about 8% by weight molybdenum, between about 0.7% and about 3.0% by weight copper, between about 3% and about 5% by weight manganese, between about 0.20 and about 0.50% by weight silicon, between about 0.01% and about 0.03% by weight carbon, between about 0.15% and about 0.20% by weight nitrogen, and between about 42% and about 53% by weight iron.

3. An alloy as set forth in claim 2 containing approximately 20% by weight nickel, approximately 18% by weight chromium, approximately 7.3% by weight molybdenum, approximately 0.8% by weight copper, approximately 3.3% by weight manganese, approximately 0.25% by weight silicon, approximately 0.02% by weight carbon, approximately 0.20% by weight nitrogen, and the balance essentially iron.

4. An alloy as set forth in claim 1 wherein the molybdenum and chromium content satisfy the relationship $$[Mo] \geqq \frac{31}{[Cr] - 12} + 2$$

where

[Mo]=weight % molybdenum and

[Cr]=weight % chromium.

5. An air meltable, workable, castable, weldable, machinable, nonmagnetic alloy resistant to sea water and corrosive process fluids, the alloy consisting essentially of between about 3% and about 8% by weight manganese, between about 12% and about 28% by weight nickel, between about 17.3% and about 19% by weight chromium, between about 0.68% and about 3.51% by weight copper, between about 0.07% and about 0.25% by weight nitrogen, between about 5.9% and about 8% by weight molybdenum, up to about 0.08% by weight carbon, up to about 1.5% by weight silicon, up to about 0.66% by weight niobium, up to about 1.32% by weight tantalum, up to about 1% by weight vanadium, up to about 1% by weight titanium, up to about 5% by weight cobalt, and between about 30% and about 56% by weight iron, the alloy being substantially free of lanthanum, the titanium content being at least about five times any excess of carbon content above 0.03% by weight, the sum of the cobalt content and the nickel content being between about 17% and about 28% by weight, and the sum of the niobium content and one half the tantalum content not exceeding about 0.66% by weight.

* * * * *